United States Patent [19]

Cygan et al.

[11] Patent Number: 4,904,280

[45] Date of Patent: Feb. 27, 1990

[54] CONDITIONING BLOCK FOR SHARPENING STONES

[75] Inventors: Stanley W. Cygan; Muni S. Ramakrishnan, both of Northboro, Mass.

[73] Assignee: Norton Company, Worcester, Mass.

[21] Appl. No.: 220,637

[22] Filed: Jul. 18, 1988

[51] Int. Cl.[4] ..... B24D 3/00

[52] U.S. Cl. ..... 51/296; 51/307; 51/309; 264/45.3; 264/45.7

[58] Field of Search ..... 51/293, 296, 307, 309; 264/45.3, 45.7

[56] References Cited

U.S. PATENT DOCUMENTS

| | | | |
|---|---|---|---|
| 224,970 | 2/1880 | Teter | 51/233 |
| 2,442,088 | 5/1948 | Kreutzer | 51/205 |
| 2,807,919 | 10/1957 | Bruce | 51/205 |
| 2,885,276 | 7/1957 | Upton, Jr. | 51/298 |
| 3,252,775 | 5/1966 | Tocci-Guilbert | 51/296 |
| 3,915,671 | 10/1975 | Kagawa | 51/296 |
| 4,035,161 | 7/1977 | Geissler et al. | 51/296 |
| 4,086,067 | 4/1978 | Busch et al. | 51/296 |
| 4,253,850 | 3/1981 | Rue et al. | 51/298 |
| 4,350,497 | 9/1982 | Ogman | 51/296 |
| 4,421,526 | 12/1983 | Strickman et al. | 264/45.3 |
| 4,459,779 | 7/1984 | Shen | 51/296 |
| 4,581,287 | 4/1986 | Smith et al. | 51/296 |

*Primary Examiner*—Paul Lieberman
*Assistant Examiner*—Willie J. Thompson
*Attorney, Agent, or Firm*—Arthur A. Loiselle, Jr.

[57] ABSTRACT

A product and process for reconditioning abrasive stones used to sharpen metal tools such as woodworking tools. The product is a slab made up of abrasive grain bond with an organic polymer.

4 Claims, No Drawings

CONDITIONING BLOCK FOR SHARPENING STONES

TECHNICAL FIELD

This invention relates to abrasive blocks for reconditioning abrasive stones used for sharpening and honing wood working tools.

BACKGROUND AND INFORMATION DISCLOSURE STATEMENT

The following publications are representative of the most relevant prior art known to the Applicants at the time of filing of the application.

U.S. Pat. Nos.

224,970 Feb. 24, 1880 W. L. Teter 2,442,088 May 25, 1948 C. Kreutzer 2,807,919 Oct. 1, 1957 S. P. Bruce 2,885,276 May 5, 1959 G. Upton, Jr.

3,252,775 May 24, 1966 B. Tocri-Guilbert 4,459,779 July 7, 1984 J. C. S. Chen

Hand tools used by carpenters for wood working in both industrial and do-it-yourself projects must be resharpened from time to time. Either man-made or naturally occuring abrasive stones are used for this tool sharpening purpose. Naturally occuring corundum, sold as "India stone", is an alumina abrasive found in Arkansas and other places that is satisfactory for this use but man-made vitrified or organic bonded stones may be found more satisfactory from the standpoint of the control of the abrasive action for accomplishing the desired resharpening of the woodworking tool. The man-made sharpening stones, for example, can be made with a relatively coarse abrasive grit in the range of 180 U.S. Sieve grit size to as fine as 1000 grit size. The coarser grit sizes are used to remove the metal of the tool to sharpen the carpenter's tool more rapidly while the finer grit sizes are used for completing the sharpening process and the finest grits are adapted to ultimately produce a mirror finish on the tool if that is desired. Thus it is usual to use several different sharpening stones having coarser to finer grits in sequence as the tool dressing process proceeds, the stones being lubricated with either water or oil as is well known. A newer type of man made sharpening stone for hand tools that is an organic bonded product used with water, is known as a "Japan stone".

During use, the exposed grits on the sharpening stones become dulled and the stones ultimately wear down to have a concave shape several thousandths of an inch deep in the area where the bulk of the sharpening action takes place, making the stone less efficient for sharpening the tools. Heretofore, such worn stones have either been discarded or subjected to a time consuming lapping operation to recondition the working face of the sharpening stone to have a planar surface.

It has been proposed in the past to provide resin bonded abrasive bodies for various uses such as is shown in the following U.S. Pat. Nos.:

2,885,276 to Upton, Jr. May 5, 1959

3,252,775 to Tocci-Guilbert May 24, 1966

4,459,779 to Shen July 7, 1984

And, dressing tools for sharpening various types of grinding devices are shown in the following U.S. Pat. Nos.:

224,970 to Teter Feb. 24, 1880

2,442,088 to Kreutzer May 25, 1948

2,807,919 to Bruce Oct. 1, 1957

The present invention provides a foam bonded abrasive means that is an improvement over the abrasive structures shown in the above patents. The prior art disclosures show examples of abrasive wheels and coated abrasive products such as the resilient wheel and flexible coated abrasive of U.S. 2,885,276. The polymerized elastomeric bond described in this disclosure as stated in column 9, line 20, provides a grinding and polishing wheel that "does not load or fill" because of the "constant flexing of the bonding film in three dimensions". Likewise, the coated abrasive type product similarly included the flexible foamed bond feature which permits the abrasive grains to give somewhat in their sockets.

Likewise, U.S. Pat. No. 3,252,775 describes a foam bonded abrasive wheel that has a resilient characteristic making it particularly useful for graining wood and polishing metal and the like. The main thrust of this invention is to provide reinforcement for a rotary polishing means to prevent distortion or indeed disintegration during use.

U.S. Pat. No. 4,459,779 teaches the manufacture of a foam bonded abrasive pad that "will not break apart under high speed rotation during grinding". This product is especially designed for use on magnetic recording disks.

U.S. Pat. No. 224,970 merely illustrates a hand held tool for dressing mill stones. The dressing means A may be made of any "suitable" material.

U.S. Pat. No. 2,442,088 shows a manual tool for dressing rotating grinding wheels.

DISCLOSURE OF THE INVENTION

The present invention makes use of a foamed resin such as polyurethane, polyvinyl chloride, polyethylene polyester, epoxy, or the like, as a bond for alumina or silicon carbide abrasive grits to form a reconditioning slab for use on worn hand manipulated sharpening stones that are typically used by carpenters for sharpening wood working tools. Abrasive grits in a size range of from as large as 46 U.S. Standard Sieve Series grit size to as small as 220 grit are secured in such a bond to provide a relatively rigid slab with a soft grinding characteristic that is especially adapted for the rapid reconditioning of such sharpening stones.

While silicon carbide and various aluminum oxide base abrasives are preferred, the abrasive could be any abrasive material such as sand, garnet, flint, boron carbide, silicon carbide, fused alumina-zirconia, sintered alumina, silicon nitride, sintered alumina-zirconia, cubic boron nitride, diamond, and the like.

A major advantage of the present invention, as will be seen from test data presented below, is the fact that it cuts or removes material much faster than known stones for this purpose, thus saving time for the skilled craftsman.

Fillers and active grinding aids well known in the art may be incorporated in the foamed organic polymer or resin bond in an amount of 1% to 30% by weight of the polymer bond.

EXAMPLES OF THE PREFERRED EMBODIMENT

When a foamed urethane abrasive reconditioning slab of this invention is made it is preferably made by mixing the selected abrasive grits with a mixture of a polyol with a Freon blowing agent and catalyst in a mixer such as a Hobart mixer and then rapidly stirring in a measured amount of an isocyanate together with the remaining quantity of the abrasive grits in a manner to avoid whipping air into the mix. The mix is then poured into a closed mold where it reacts, heats up and evaporates the blowing agent, causing the resin to foam up and fill the mold. When the resin mix is set, the molded product can be easily stripped from the mold. If additional curing is deemed necessary, this stripped foamed abrasive product can be baked to complete the polymerization of the resin composition.

A typical example of a preferred form of the abrasive slab of this invention can be made by weighing out 2.5 pounds of polyol (including blowing agent) into a mixing container, the polyol being a golden liquid with a viscosity of approximately 6000 cps (specification) and weighing out 2.5 pounds of a black liquid isocyanate in a separate vessel, the isocyanate having a viscosity of approximately 200 cps (spec.). Both liquid resins can be purchased from the Stepan Chemical, Inc. of Northfield, Illinois, under the code identifications of HW11/60R and HW11/60T respectively.

Also, 10 pounds of 80 grit silicon carbide abrasive grits are weighed out. The polyol and about 8 or 9 pounds of the abrasive grits are quickly stirred together in a Lightnin mixer that is driven by a compressed air motor. The abrasive is poured into the polyol as soon as the propellar starts turning and the speed of the propellar is increased as the mix becomes thicker. The air pressure used at the start was 20 p.s.i. and within 1½ minutes the driving air pressure was increased to 45 p.s.i.

The polyol and abrasive grit form a paste wherein the abrasive grits are heavily wetted with the liquid resin. At this point the air pressure drive for the propellar is reduced to 20 p.s.i. and all of the isocyanate and remaining abrasive, if any, are mixed together with the paste as rapidly as possible, without producing a whipping action that would mix air into the batch. This isocyanate mixing step is complete in 2 minutes.

The resulting liquid mixture of polyol, isocyanate, and abrasive grits, is quickly poured into a closed mold where the polyol and isocyanate react, vaporizing the blowing agent and causing the urea resin to foam. The closed mold was heated to about 55° C. which together with an exothermic reaction assured a proper foaming action while the temperature within the reacting mass increased until it reached about 100° C. The foamed resin was cured to a sufficient degree to be stripped from the mold in about 30 minutes and the final curing action was completed by storing the stripped foam bonded abrasive composite at room temperature for at least a week.

Additional specimens of 80 grit and 100 grit molded foam bonded silicon carbide abrasive slabs are fabricated as described above with some receiving no further heat treatment after foaming; some are post heat treated at 120° C., while a third group is post heat treated at 140° C. The heat treatments are carried out for four hours.

All of the examples of the foamed abrasive product described above are molded in a cylindrical steel mold with a diameter of 9 19/32" and a height of 5 30/32" having a volume of about 424 cubic inches. The abrasive and resin mix is foamed to have a closed cell structure with a porosity of about 68% and a density in the range of about 0.64 gms/cc. As above described, fifteen pound batches of resin components and abrasive mix are made up, and of each such batch, 9.96 pounds are poured into the cylindrical mold in order to produce the finished foamed abrasive products, each having a desired density of about 0.64 gms/cc.

After curing the several foamed resin abrasive products as above described, the molded cylindrical masses are cut into slabs for use in reconditioning the worn wood working tool sharpening stones. The invention reconditioning slabs were compared to the prior art "Japan and India" stones. The resin bonded slab used is manually rubbed against the flat surface of the wood working tool sharpening stone that is being reconditioned, first with a motion using a figure eight pattern, then a circular motion, and including a rotation of the reconditioning slab 180° relative to the stone during the rubbing action. The sharpening stones being reconditioned are measured for thickness with a micrometer in three places before and after being subjected to the reconditioning process and the thickness of each of the reconditioning slabs themselves are taken at four places. The following tables show the results of the tests:

TABLE I

| | Type of Sharpening Stone | Rubbing Time (Minutes) | Sharpening Stone wear part of in. | Reconditioning Slab wear part of inch | Slab type of resin cure/100 grit |
|---|---|---|---|---|---|
| 1. | India stone 220/320 grit | 5 | .001 | .022 | Room Cure |
| | Organic bond 500/800 grit | 5 | .006 | .012 | Room Cure |
| | Japan stone 800 grit | 5 | .003 | .018 | Room Cure |
| 2. | India stone 220/320 grit | 5 | .002 | .023 | 4 Hours @ 120° C. |
| | Organic bond 500/800 grit | 5 | .005 | .014 | 4 Hours @ 120° C. |
| | Japan stone 800 grit | 5 | .004 | .018 | 4 Hours @ 120° C. |
| 3. | India stone 220/320 grit | 5 | .001 | .021 | 4 Hours @ 140° C. |
| | Organic bond 500/800 grit | 5 | .008 | .011 | 4 Hours @ 140° C. |
| | Japan stone 800 grit | 5 | .005 | .019 | 4 Hours @ 140° C. |

TABLE II

| | Type of Sharpening Stone | Rubbing Time (Minutes) | Sharpening Stone wear part of in. | Reconditioning Slab wear part of inch | Slab type of resin cure/100 grit |
|---|---|---|---|---|---|
| 4. | India stone 220/320 grit | 5 | .001 | .022 | Room Cure |
| | Organic bond 500/800 grit | 5 | .006 | .012 | Room Cure |
| | Japan stone 800 grit | 5 | .007 | .015 | Room Cure |
| 5. | India stone | | | | 4 Hours |

TABLE II-continued

| Type of Sharpening Stone | Rubbing Time (Minutes) | Sharpening Stone wear part of in. | Reconditioning Slab wear part of inch | Slab type of resin cure/100 grit |
|---|---|---|---|---|
| 220/320 grit Organic bond | 5 | .001 | .023 | @ 120° C. 4 Hours |
| 500/800 grit Japan stone | 5 | .004 | .020 | @ 120° C. 4 Hours |
| 800 grit | 5 | .006 | .019 | @ 120° C. |
| 6. India stone | | | | 4 Hours |
| 220/320 grit Organic bond | 5 | .002 | .014 | @ 140° C. 4 Hours |
| 500/800 grit Japan stone | 5 | .003 | .011 | @ 140° C. 4 Hours |
| 800 grit | 5 | .008 | .022 | @ 140° C. |

The improved reconditioning slabs of the invention can be made with a porosity of from 40 to 80%, but the preferred examples as above described are typically foamed to have about 60% closed cell pores. Any suitable mixer such as a Hobart or Lightnin may be used for mixing the polyol and isocyanate providing only that the mixing be done rapidly enough to accommodate the very short pot life of the mixed ingredients in the range of 1 or 2 minutes. The addition of the abrasive to the polyol as a premixing step tends to lengthen the pot life as much as 30 seconds so that, when the isocyanate is added to the polyol and abrasive mix, the two react to generate the blowing agent; there is about a two minute period to complete the mixing operation.

Any closed mold shape can be used to contain the mixed resin and abrasive components as the foaming action proceeds. It is necessary only that it be of a shape to permit rapid filling and closing whereby to mold the reacting mass within the defined volume of the closed mold to produce a finally cured product having the desired density.

The complete mixing and pouring of the reacting mixture into the mold should be completed within a time frame of approximately 2 to 3 minutes. If the viscosity of the mix is too low, the abrasive grits tend to settle out, and if it is too high, pouring the mixed mass into the mold becomes difficult. Similarly, the mold temperature control is important. It should be heated to a temperature above 50° C. before the pouring begins. The reaction of the mixed polyol and isocyanate is exothermic and the mix heats up and starts to foam energetically within three to five minutes. To some extent the foaming action is also dependent upon the liquid ratios mixed together and the amount of the abrasive grits mixed therewith.

While the above covers a description of the preferred form of our invention, it is possible that variations thereof may occur to those skilled in the art, that will fall within the scope of the following claims.

What is claimed is:

1. A porous slab for reconditioning cutting tool sharpening stones comprising abrasive grain and a foamed organic polymer bond therefor, said porous slab having an amount of porosity of from 40% to 80%, said abrasive grain having a grit size of from about 46 to about 220 based on U.S. Standard Sieve Series.

2. The porous slab of claim 1 wherein said organic polymer bond is one selected form the group consisting of polyurethane, polyvinyl chloride, polyethylene, polyester, and epoxy.

3. The porous slab of claim 2 wherein said abrasive grain is one selected from the group consisting of silicon carbide, sand, garnet, flint boron carbide, silicon nitride, fused alumina, sintered alumina, cofused alumina-zirconia, sintered alumina-zirconia, cubic boron nitride, diamond, and mixtures thereof.

4. The porous slab of claim 3 wherein said foamed organic polymer bond contains 1-30% of a filler and/or grinding aid.

* * * * *